United States Patent [19]

Lagain

[11] Patent Number: 4,764,160

[45] Date of Patent: Aug. 16, 1988

[54] CUTTING APPARATUS FOR A MACHINE USED FOR MAKING BAGS, POUCHES AND THE LIKE FROM THERMOPLASTIC MATERIAL

[75] Inventor: Georges Lagain, Enghien-les-Bains, France

[73] Assignee: FMC Corporation, Chicago, Ill.

[21] Appl. No.: 39,043

[22] Filed: Apr. 16, 1987

[30] Foreign Application Priority Data

Apr. 18, 1986 [FR] France ..... 86 05658

[51] Int. Cl.[4] ..... B31B 1/64

[52] U.S. Cl. ..... 493/194; 493/199; 493/203; 493/204

[58] Field of Search ..... 493/194, 199, 203, 204, 493/206, 209, 195; 83/614, 661, 790; 30/380, 385, 386

[56] References Cited

U.S. PATENT DOCUMENTS 4,030,388 6/1977 Ramsey ..... 83/661
4,230,029 10/1980 Schott, Jr. ..... 493/195

FOREIGN PATENT DOCUMENTS 900020 10/1984 Belgium .
0056102 7/1982 European Pat. Off. .
0141718 5/1985 European Pat. Off. .
2031713 11/1970 France .
2566741 1/1986 France .

*Primary Examiner*—Frederick R. Schmidt
*Assistant Examiner*—Robert Showalter
*Attorney, Agent, or Firm*—R. E. Parks; D. W. Rudy; R. B. Megley

[57] ABSTRACT

A cutting apparatus for severing a sheath of thermoplastic material during a bag manufacturing operation. The cutting apparatus comprises a stationary frame (1) having a pair of timing pulleys (130, 131) mounted thereon which intermittently drive an endless timing belt (61) looped around the pulleys. The timing belt carries a cutter blade (56) across the width of the sheath during an intermittent cutting run for severing the sheath. The mid-portion of the timing belt is vertically displaceable by two pairs of vertically and horizontally spaced apart guide pulleys (135–138) supported on a vertically moveable frame (143, 71, 144) centered between the timing pulleys on the stationary frame. The vertically displacement of the mid-portion of the timing belt positions the cutter blade for the cutting run across the width of the sheath.

14 Claims, 4 Drawing Sheets

CUTTING APPARATUS FOR A MACHINE USED FOR MAKING BAGS, POUCHES AND THE LIKE FROM THERMOPLASTIC MATERIAL

This invention is related to the bag making machine disclosed in my U.S. patent application, Ser. No. 06/941,879, filed on Dec. 15, 1986, entitled Bottom Seal Bag Making Machine, and claiming priority of my French Patent Application No. 86 00 027, filed on Jan. 1, 1986, and to a companion U.S. patent application, Ser. No. 07/039055 filed on this day, Apr. 16, 1987 together with this application and claiming priority of my French patent application No. 86 05 657, filed on Apr. 18, 1986, entitled A Machine For The Manufacture And Stacking Of Bags, Pouches And The Like Made From A Thermoplastic Material.

The present invention is related to a device or apparatus for use in severing or cutting a tube or sheath of thermoplastic material in a machine for manufacturing bags, pouches and the like. The cutting or severing device is provided in a location that is downstream from a set of two welding jaws. It is of the type, such as shown in my French Pat. No. 84 10470, Publication No. 2,566,741, dated Jan. 1 and 3, 1986, comprising a toothed endless timing belt above the sheath transportation trajectory, which extends in a transverse vertical plane and carries a knife, or blade, and runs over a pair of toothed timing pulleys spaced apart from each other by a distance greater than the width of the sheath or tube to be cut or severed. One of the timing pulleys is connected to a motor or driving member. Below the trajectory of transportation of the sheath, there is a counter-blade member capable of cooperating with the knife for the purpose of the transverse cutting or severing of the sheath. The cutting device further comprising support means for the toothed drive and return pulleys and the toothed endless timing belt. Means are provided for moving the lower side of the belt in close proximity to the counter-blade member as soon as the two welding jaws have been brought together to a welding position thereby clamping the sheath therebetween and tightening the sheath between the jaws and a blocking shoe positioned downstream from the timing belt which is capable of tightening the extreme end part of the sheath against a stacking table and against the upper face of one or more cut and welded bags which rest on the stacking table. The stacking table is located underneath the sheath trajectory and downstream from the counter-blade member.

That type of cutting device is known, for example, through U.S. Pat. No. 4 230 029, to Schott, Jr., issued on Oct. 28, 1980, which has the two toothed drive and return pulleys mounted on a support which can pivot so as to bring the lower side of the toothed timing belt into a position which makes it possible for the knife or blade to section the tightened sheath, which has one part tightened between the two welding jaws and a second part tightened between the blocking shoe and the stacking table. Another cutting device is known through my French Pat. No. 6902489, published on Nov. 20, 1970 under Publication No. 2 031 713, which does not have a blocking shoe nor a stacking table, but has the two timing pulleys, for the timing belt which carries the knife or blade, mounted on a support cross-piece which is movable in a vertical plane so as to be able to move the upper knife or blade in close proximity to the lower counter-blade member.

One drawback of those two known devices resides in the fact that non-negligible masses must be accelerated and braked rapidly before and after each sheath cutting operation in order to bring the knife or blade in close proximity to, and then moving it away from, the trajectory of the sheath. Another drawback consists in the use of a relatively long cardan shaft to compensate for the variation in spacing between a bevel gear pinion having a fixed position and the timing pulley which is driven and moves in a vertical plane.

The present invention has as its purpose to eliminate the aforementioned drawbacks and to improve the cutting device of the abovementioned types so as to appreciably reduce the masses to be accelerated and to be braked, in the course of a cutting cycle, and so as to obtain very high cutting frequencies.

To that end, and according to the present invention, the drive and return toothed timing pulleys are mounted in a fixed in place manner on the frame of the bag making machine so that a horizontal plane tangent to the bottom of the two driving and return timing pulleys remains permanently located parallel and above the horizontal sheath cutting plane. The length of the toothed endless timing belt is greater than the length of the shortest possible imaginary loop running around the two toothed drive and return pulleys. The toothed endless belt is associated with a belt displacement means for displacing at least a middle portion of the lower run of the timing belt, in a manner such that the lower middle run portion corresponds to the width of the sheath. The belt displacement means is able to move from a raised or high position in which the lower middle run portion is spaced above the horizontal sheath cutting plane, to a lowered or low position in which the lower middle run portion is positioned in the proximity of the counter-blade member and is in the trajectory path of the sheath, so as to ensure the cooperation between the latter and the knife or blade when the knife moves along the lower middle run portion to sever the sheath.

Thanks to that design, only a part of the toothed belt and the displacement means are displaced in order to rapidly move the lower middle run portion of the belt from the high holding or waiting position, in which the latter is vertically spaced from the counter-blade, to the low cutting position, in which it is now possible for the knife or blade fixed to the belt to enter into the cutting plane and to cut the sheath. As the toothed drive and return pulleys are mounted to the machine in a fixed in place manner, the kinetic connection between one of those pulleys and a motor or other central driving member, such as the main shaft of the machine, can be simplified, and the cardan shaft can be eliminated.

Other characteristics and advantages of the invention will be seen in the following description of an exemplary embodiment of the invention, to be read in connection with the various figures in the accompanying drawing in which.

There will be described below one mode of operation of the cutting device according to the present invention, in connection with a machine for manufacturing bags made from a thermoplastic material which is described in more detail in my aforementioned French Patent Application No. 86 05 657. It is, however, understood that the cutting device according to the present invention can also be used in combination with other machines used for the manufacturing of bags other than the one described in my abovementioned French Patent Application.

Figure 2:
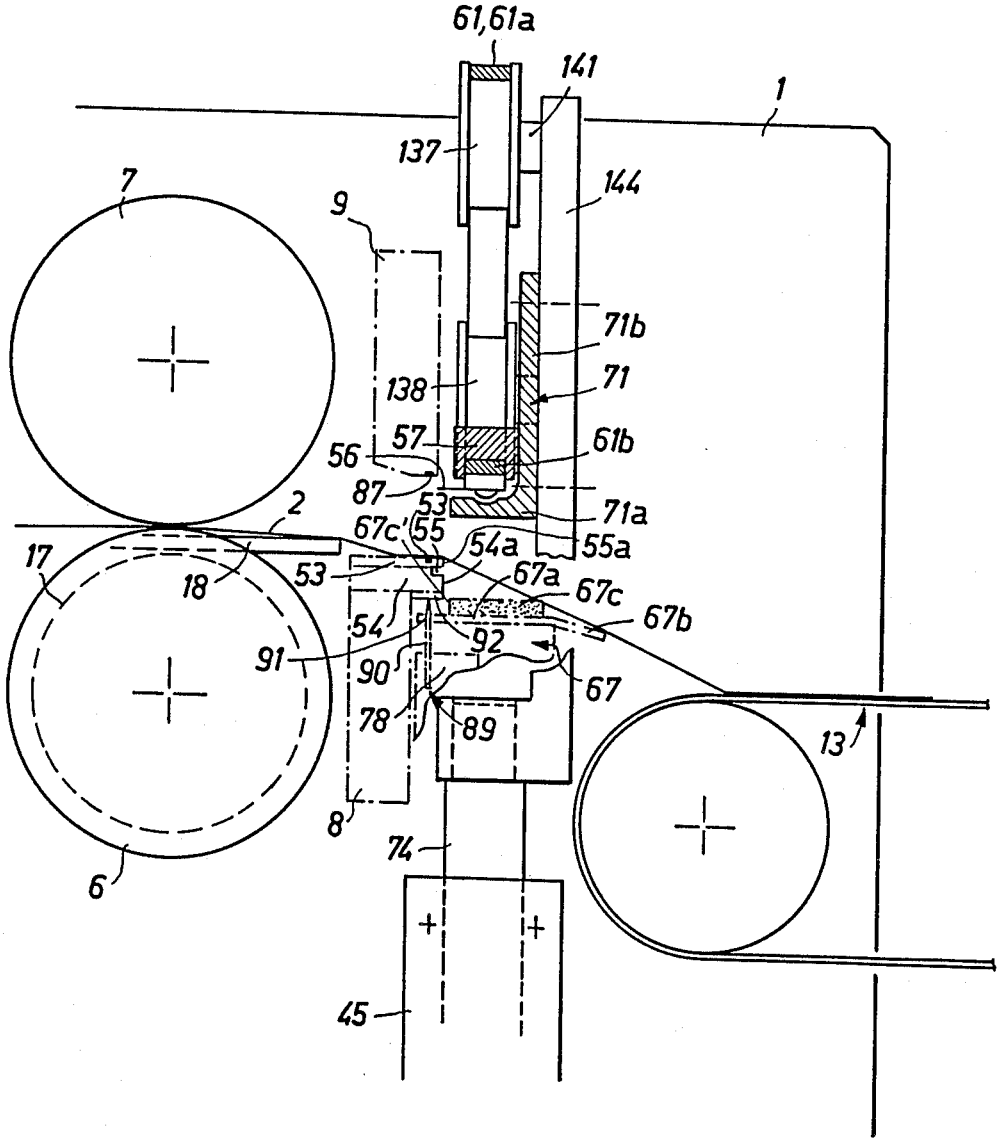
FIG. 2 is a sectional side elevation view of a longitudinal vertical section of the cutting device and of other elements of the downstream portion of a bag making machine taken through line II—II in FIG. 1.
Figure 4:
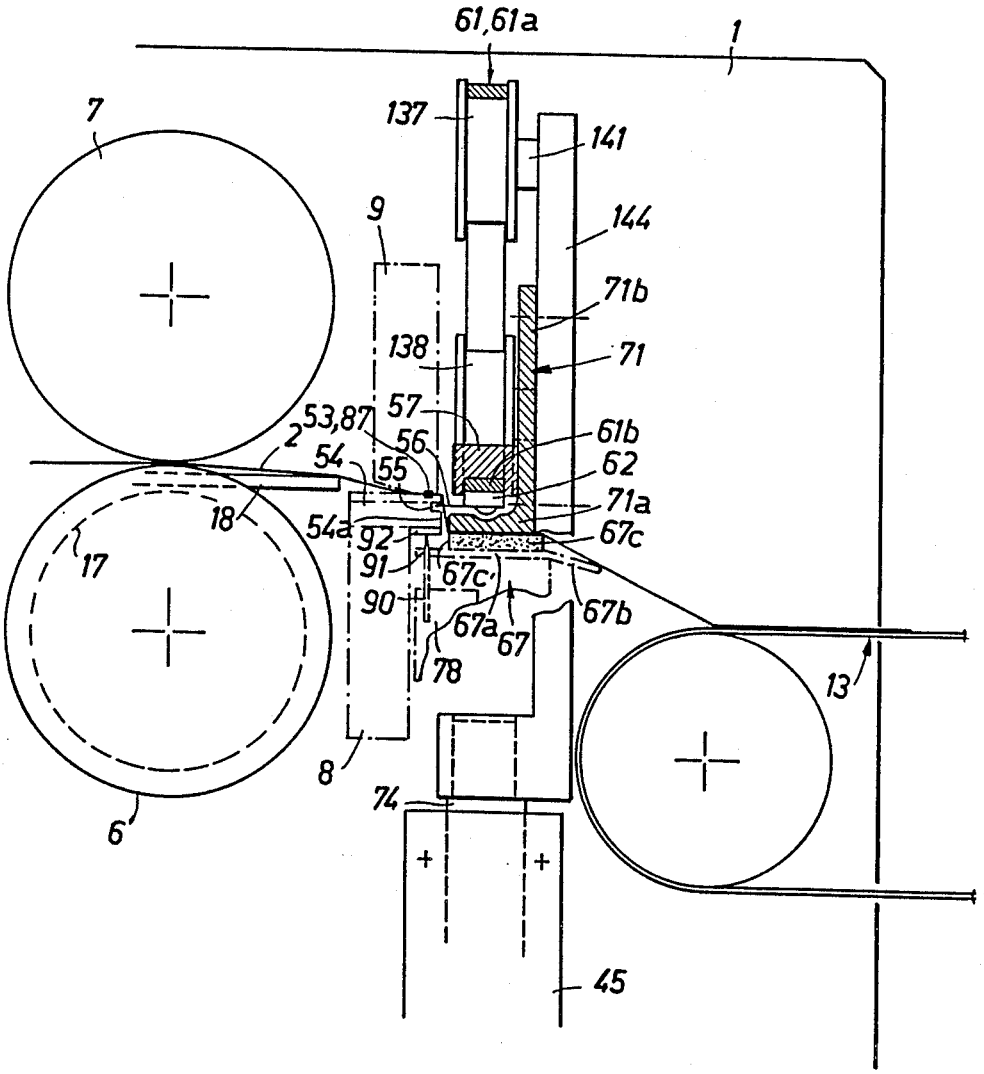
FIG. 4 is similar to the sectional side elevation view of FIG. 2 taken through line IV—IV in FIG. 3.

With reference to FIGS. 2 and 4, the means or cutting device for cutting a sheath of thermoplastic material 2 is placed downstream from a set of two cooperating transporting lower and upper rollers 6 and 7, and from a set of two cooperating lower and upper welding jaws 8 and 9. The trajectory of sheath 2 first runs from upstream to downstream between the lower transporting roller 6 which is journalled to the machine 1 in a fixed in place manner, and the upper transporting roller 7 which is movably mounted to the machine 1 for vertically moving away from lower roller 6, and between the lower welding jaw 8 and the upper welding jaw 9, before it runs between a lower stacking table 67 and a blocking shoe 71 and finally over an endless transportation belt 13 which serves for the removal of the welded bags which are stacked in a pile on the stacking table 67 and on the upstream part of the transporting belt 13 after they have been cut from the extreme downstream part of sheath 2. The lower transporting roller 6 is fitted with a plurality of annular grooves 17 which receive between the lower roller 6 and the upper transporting roller 7, horizontal blowing tubes 18 which extend below sheath 2 as far as the proximity of welding jaws 8 and 9.

In the case of the mode of operation which is represented by the machine 1 for use in manufacturing thermoplastic bags, the lower welding jaw 8 comprises, at its upper part, a retaining shoulder 54 which projects downstream and having on its vertical frontal downstream face 54*a* a horizontal cutting groove 55 open along the downstream side and open at both lateral ends, and which comprises a part of the cutting device as the counter-blade member. On the upper face, and close to the cutting groove 55, the lower jaw 8 is fitted with a transverse welding line 53 which is parallel to cutting groove 55 and which is located in the same vertical plane as a welding line 87 provided for on the lower face of the upper jaw 9 and comprising an electric resistance wire. On its horizontal lower face, out of plumb relative to the vertical body 54*a* of lower jaw 8, the retaining shoulder 54 is fitted with an insertion shoe 92 which serves to insert the upstream end of the welded and cut bags over a row 89 of vertical needles or pins 90 provided for on the upper part of a pin-carrier 78.

The stacking table 67 comprises, in the particular case represented in the drawing as an example only, of a support small beam 67*a*, of a support plate 67*b* which projects from the upper face of the small beam 67*a* in the downstream direction as well as in the upstream direction and comprising, below the insertion shoe 92, a row of vertical passage holes 91 through which pass the upper part of needles or pins 90, as well as an elastic damper pad 67*c* affixed to the upper face of support plate 67*b* in a manner such that its upstream transverse vertical face 67*c* is located in the immediate neighborhood and slightly downstream from the frontal downstream vertical face 54*a* of retaining shoulder 54.

Figure 1:
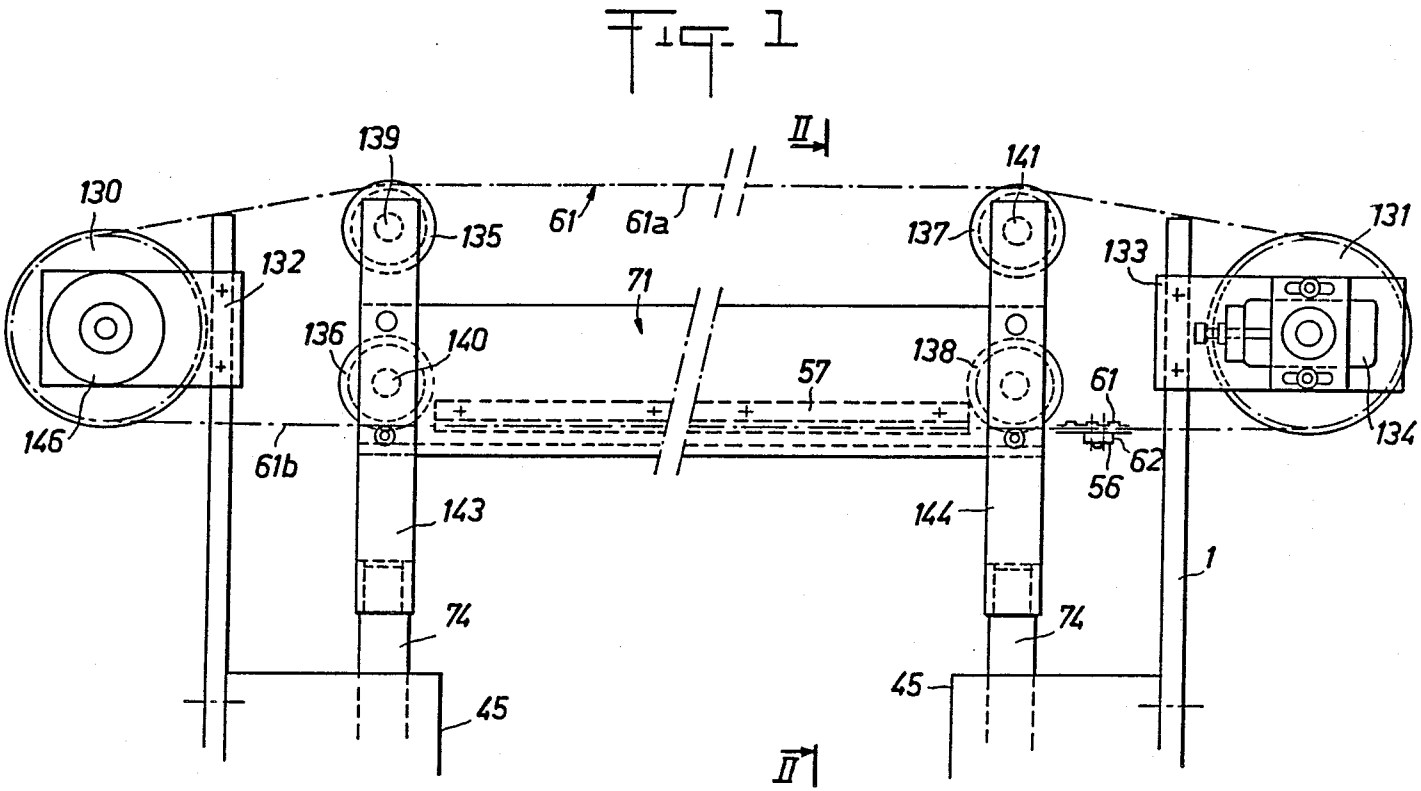
FIG. 1 is a partial front elevation view of the cutting device according to the present invention, which shows the lower middle run portion of the toothed timing belt in the high waiting or holding position.
Figure 3:
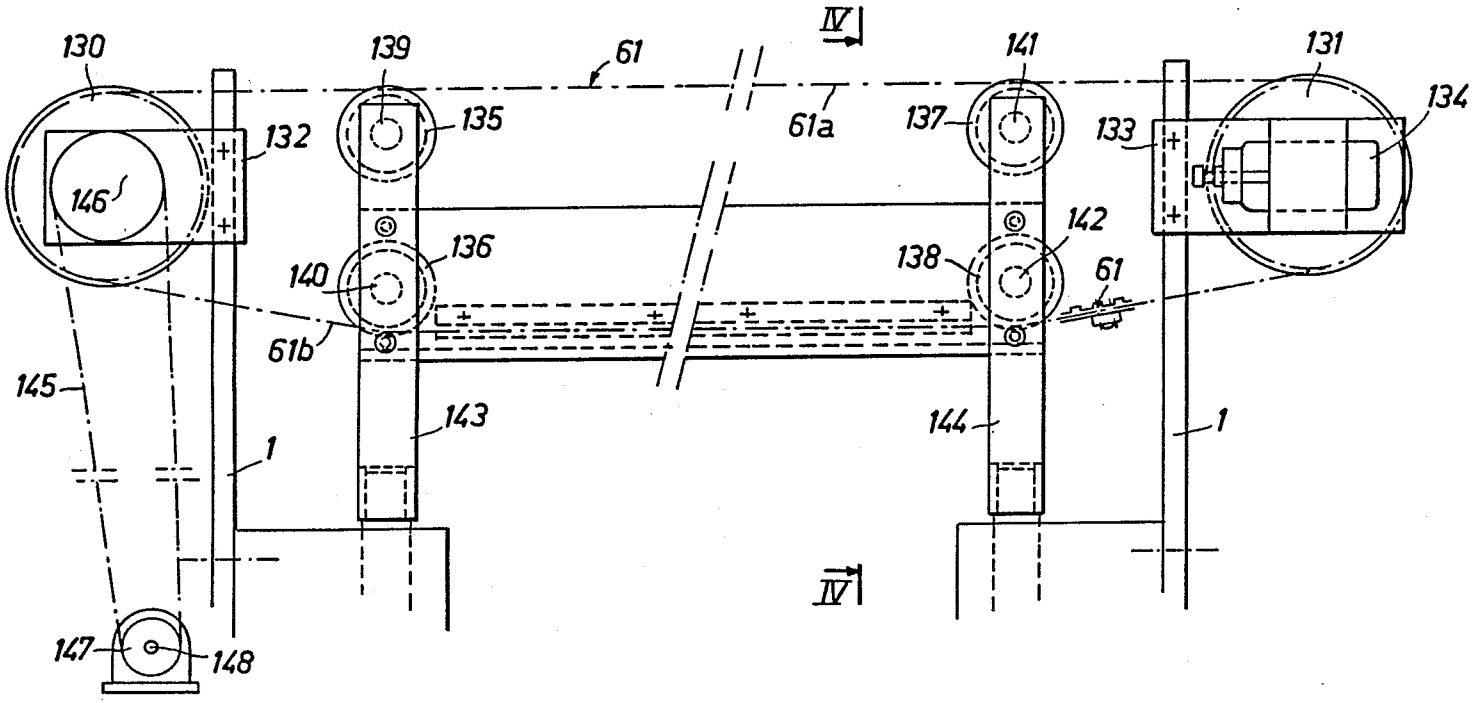
FIG. 3 is similar to the partial front elevation view of FIG. 1 which now shows the lower middle run portion side of the toothed timing belt in the lowered cutting position in which the knife or blade carried by the belt is cutting the sheath.

The cutting device shown in FIGS. 1 and 3 comprises two toothed timing pulleys 130 and 131, mounted in a fixed in place manner above and on each side of the sheath trajectory, rotatably mounted on vertical flanges 132 and 133 or side plates mounted to the frame 1 of the machine for manufacturing thermoplastic bags, pouches, pockets or the like, in a manner such that the transverse trajectory of toothed belt 61 which runs around the two drive and return timing pulleys 130 and 131 will be located downstream and at proximity of the jaws 8 and 9, in a transverse vertical plane which is parallel to the downstream frontal faces of the jaws 8 and 9. The drive and return pulleys 130 and 131 are supported in bearings provided for on transverse support plates 132 and 133, each one of them affixed to one of the lateral vertical side plates of frame 1, the bearing of one pulley 131 is fitted with a belt tensioning mechanism 134 having a laterally adjustable bearing carrier or box for regulating or adjusting the tension of the toothed belt 61, which is associated with a belt displacement means.

On each side, above the trajectory of sheath 2 and inside the loop formed by toothed belt 61 running around the two drive and return pulleys 130 and 131, the axes of which are placed parallel to each other in a same horizontal plane, there are provided two pairs of upper and lower toothed guiding pulleys 135, 136 and 137, 138, which are vertically supported on a pair of risers 139 and 140 in a manner such that the upper pulleys 135, 137 of each of the two pairs of guiding pulleys in one position take up the slack at the midsection of the timing belt by bearing against the internal cogged face of the upper side 61*a* of toothed belt 61, and that each of the lower pulleys 136, 138 of the two pairs of guiding pulleys in another position take up the slack by bearing against the internal cogged face of the lower side 61*b* of toothed belt 61. The two pairs of guiding pulleys form a part of the belt displacement means mechanism for taking up the slack by the displacement of the midsection of the toothed belt 61. It must be noted that the axes of each of the upper guiding pulleys 135, 137 are in a same horizontal plane, and that the axes of each of the lower guiding pulleys 136, 138 are in another horizontal plane, parallel to the cutting groove or counter-blade 55, FIGS. 2 and 4, so that at least that upper horizontal run section 61*a* of belt 61, which extends between the two upper guiding pulleys 135, 137 and that the lower horizontal run section 61*b* of belt 61 which extends between the two lower guiding pulleys 136, 138 extend horizontally and parallel to each other and to the cutting groove 55 provided in the frontal face 54*a* of retaining shoulder 54 of the lower welding jaw 8. The belt sections located between one of the guiding pulleys 135, 136 and 137, 138 and a neighboring timing pulley 130 and 131 assume two positions, either horizontal or sloped, as shown in FIGS. 1 and 3 depending on the elevation of the vertical risers 143 and 144.

Each pair of the two pairs of guiding pulleys 135, 136 and 137, 138 is rotatably mounted to the risers 143 and 144 by means of upper and lower horizontal shafts 139, 140, and 141 and 142. The vertical risers 143 and 144 are vertically movable between two positions. One position is a high position, as shown in FIGS. 1 and 2, in which the lower run 61*b* of the cogged timing belt 61 between the two lower guide pulleys 136, 138 and the adjacent timing and drive pulleys 130 and 131 is in a horizontal position, which is the holding or waiting position for the cutter blade 56. The timing belt carries at least one cutter assembly comprising a horizontal extending knife blade 56 affixed to the external non-toothed side of the timing belt 61 by means of a fixation tab 62. The lower horizontal run portion 61*b* located between the two lower guiding pulleys 136, 138 is spaced vertically above the trajectory of the sheath and occupies a holding or waiting position. When the risers 143 and 144 are lowered to the second position shown in FIGS. 3 and 4, the former horizontal portion of the lower side 61*b* located between the two lower guiding pulleys 136, 138 and the adjacent driving and timing pulleys 130 and 131 is now sloped directing the cutter 56 into the horizontal run between the two lower guide pulleys 136, 138 and into the path of the trajectory of sheath 2 in a manner such that the knife 56 can enter and engage in cutting groove 55 from one lateral open end of the same and section the sheath while rapidly passing through the groove 55 along the lower horizontal run portion 61*b* of toothed belt 61 extending between the two lower guide pulleys 136, 138.

By means of this construction, only the upper lateral side portions and the lower lateral side portions of the timing belt 61 displacements are displaced by displacements of the upper and lower midsections of the loop formed by toothed belt 61, without the length or the tension of the belt loop being changed.

The two risers 143 and 144 and the two pairs of guiding pulleys 135, 136 and 137, 138 are each supported by the upper end of a vertical guiding rod 74 which moves inside a guiding box 45 affixed to the frame, the lower end of those guiding rods 74 cooperating with a cam, not shown, which governs the upward and the downward displacements of risers 143 and 144 and of the pairs of guiding pulleys 135, 136 and 137, 138, in synchronism with the displacements of the other elements and members of the machine for use in the manufacture of bags, such as the transporting rollers 6, 7, welding jaws 8, 9 and the blocking shoe 71. Advantageously, the two supporting risers 143 and 144 for the two pairs of guiding pulleys 135, 136 and 137, 138 also serve as support for the blocking shoe 71 which comprises an angle iron beam member having one leg 71*a* extending horizontally in an upstream direction toward the jaws 8 and 9 and extending as far as the vertical frontal face 54*a* of the retaining shoulder 54 and having the other leg 71*b* extending vertically and upwardly and laterally affixed to the two support risers 143 and 133. On the vertical upstream facing side of the vertical leg 71*b* and above the horizontal leg 71*a* of the blocking shoe 71 is mounted a transerve horizontal guiding channel bar member 57 for guiding the lower horizontal run 61*b* of the timing belt 61 between the lower guiding pulleys 136, 138. In that way, there is assurance that the knife 56 moving over the lower horizontal run portion 61*b* of the timing belt 61 engages with precision into the cutting groove 55 provided for on the vertical frontal face 54*a* of the retaining shoulder 54 mounted to the lower jaw 8 when the vertical risers 143 and 144 and the lower horizontal run portion 61*b* are moved to the low cutting position shown in FIGS. 3 and 4. A belt guiding groove 71*c* is provided in the horizontal leg 71*a*.

One of the cogged drive and return pulleys 130 and 131, for example pulley 130, which has an axle shaft mounted in the bracket 132 which is fixed in place to the frame 1, has an end connected to a sprocket gear 146 which is driven by means of a chain or endless link-belt 145 which in turn is driven by a sprocket gear 147 connected to the drive shaft of a motor 148 mounted to the machine 1.

The examplary embodiment described above for the cutting device means, according to the present invention, is described in relation to the bag making and bag stacking machine described in my aforementioned French Patent Application No. 86 05 657. The present description of the cutting device means uses the same reference numbers as those used in the companion French patent application for describing the machine incorporating the present cutting device means. However, it is well understood that the cutting device means which is the subject of the present patent application, may just as well be used with other machines used for the manufacture of bags from a sheath of thermoplastic material. It is also understood that the above described exemplary embodiment of the invention may be modified without departing from the scope of the present invention as defined in the claims.

What is claimed is:

1. A cutting apparatus for cutting a sheath of thermoplastic material crosswise comprising a frame (1,1) having laterally spaced sides, a pair of timing pulleys (130, 131) journally mounted to the sides with the axes of rotation lying on a fixed horizontal plane vertically spaced from an intermittent trajectory path of the sheath moving intermittently into the cutting apparatus, an endless timing belt (61) looped over the timing pulleys, a cutter blade (56) fixed to an external side of the timing belt, two pairs of laterally spaced upper and lower guide pulleys (135, 136 and 137, 138) engaging the timing belt on opposite internal sides of the timing belt and journally mounted to a pair of laterally spaced vertically movable upright beam members (143, 144) supported on the frame, the guide pulley axes (139, 140 and 141, 142) of the two pairs of upper and lower guide pulleys lying on fixed parallel vertical planes passing through the upright beam members, the horizontal distance between the vertical planes of the guide pulley axes defining a lateral horizontal cutting run for the cutter blade passing across the width of the sheath, the guide pulley axes of the two pairs of upper and lower guide pulleys further lying on vertically spaced parallel horizontal planes having a fixed vertical distance greater than two horizontal parallel planes passing tangent to the timing pulleys, means (134) for laterally moving one of the timing pulleys along the horizontal plane of the axes of rotation for adjusting the tension of the timing belt looped around the timing and guide pulleys, means (146, 145, 147, 148) for intermittently driving one of the timing pulleys in timed relation with the intermittent movement of the sheath for effecting the lateral horizontal cutting run of the cutter blade, means (45, 74) for vertically moving the upright beam members in timed relation with the intermittent movement of the sheath from one vertical position to a second position for positioning that portion of the timing belt extending along the horizontal cutting run for the cutter blade into the intermittent trajectory path of the sheath, and means for energizing the driving means in timed relation with the intermittent movement of the sheath for moving the cutter blade on the timing belt into a grooved counter-blade (55, 54*a*) supported on the frame for severing the sheath crosswise therebetween.

2. The cutting apparatus claimed in claim 1, wherein the vertical distance between the parallel horizontal planes of the guide pulley axes (139, 140 and 141, 142) is such that in the first vertical position of the upright beam members (143 and 144) one of the tangential horizontal parallel planes is also tangent to one guide pulley of each of the two pairs of guide pulleys and when the upright beam members are in the second vertical position the other tangential horizontal plane is tangent to the other one guide pulley of each of the two pairs of guide pulleys.

3. The cutting apparatus claimed in claim 2 wherein in the first vertical position of the upright beam members (143 and 144) the other one guide pulley (136 and 138) of each of the two pairs of guide pulleys and the section (61*b*) of the timing belt extending therebetween are vertically spaced from the other tangential horizontal plane and are positioned in the intermittent trajectory path of the sheath preparatory for the horizontal cutting run of the cutter blade (56), and when the upright beam members are in the second vertical position the one guide pulley (135 and 137) of each of the two pairs of guide pulleys and the section (61*a*) of the timing belt extending therebetween are vertically spaced from the first mentioned tangential horizontal parallel plane defining a holding position of the timing belt and cutter blade.

4. The cutting apparatus claimed in claim 3, wherein the adjustment means comprise a bearing block mounted to the frame (133) and having a laterally movable bearing carrier (134), and the one timing pulley (131) is a timing belt return pulley and is rotatably mounted to the bearing carrier.

5. The cutting apparatus claimed in claim 4, wherein the driving means comprise a sprocket gear (146) mounted to the other timing pulley (130), a motor mounted to the frame and having a power shaft (148) with a sprocket gear (147) thereon, and a chain belt (145) looped around the sprockets.

6. The cutting apparatus claimed in claim 5, wherein the upright beam members (143 and 144) are connected at their lower ends to vertically movable guiding rods (74 and 74), and the guiding rods are connected to a guiding box means (45) mounted to the frame for moving the rods in synchronism with the intermittent trajectory of the sheath, and the upright beam members are connected together by a laterally extending horizontal beam member (71) vertically spaced above the lower ends and having means for journally mounting the lower guide pulleys (136 and 138) of the two pairs of guide pulleys to the upright beam members, the upper guide pulleys (135 and 137) vertically spaced above the horizontal beam member and journally mounted to upper end portions of the upright beam members, and a laterally extending horizontal channel bar member (57) mounted to the horizontal beam member having a length approximate the distance of the horizontal cutting run of the cutter blade for guiding the timing belt and cutter blade along the grooved counter blade.

7. The cutting apparatus claimed in claim 6, wherein the horizontal beam member comprises an angle iron having an upright leg (71*b*) connected on one side to the upright beam members and the opposite side supporting the channel bar member and the lower guide pulleys, and having a horizontal leg (71*a*) vertically spaced below and extending under the channel bar member and the section of the timing belt guided by the channel bar member, the horizontal leg when moved by the upright beam members to the first vertical position cooperating with a resilient pad (67*a*) mounted on the frame and vertrically spaced from the counter-blade to grasp the sheath therebetween and tension sheath against the counter-blade.

8. The cutting apparatus claimed in claim 7 wherein the frame comprises the frame of a machine for the manufacture of thermoplastic bags, pouches and the like, and the cutting apparatus is mounted to the lateral sides of the machine downstream of one vertically movable upper welding jaw means (9) cooperating with a stationary lower welding jaw means (8) and wherein the counter-blade is mounted to the stationary lower welding jaw, and the resilient pad is mounted below the counter-blade on a bag stacking table (67*b*).

9. In a machine used for the manufacturing of bags, pockets and the like from a flattened sheath of a thermoplastic material, an improved cutting apparatus for severing the sheath projecting downstream from between an upper vertically movable welding jaw (6) and a lower stationary welding jaw (8), the cutting apparatus of the type comprising an endless timing belt (61) with a knife (57) fastened thereto and looped around a pair of driving and return timing pulleys (130 and 131) mounted to lateral side members (1 and 1) of the machine, the timing pulleys laterally spaced apart by a distance greater than the width of the flattened sheath, the driving pulley connected to a motor (148) by a chain transmission, a counter-blade member (55) having a laterally extending groove (54*a*) positioned below the downstream projecting sheath cooperating with the knife on the timing belt for transversely severing the downstream projecting sheath, means for lowering a midsection of the lower run (61*b*) of the timing belt and positioning the knife for entry into the groove of the counter-blade member in timed relation to the downward movement of the upper jaw toward the lower jaw, means for activating the motor and driving the timing pulley concurrent with the upper jaw clamping the sheath to the lower jaw, and blocking shoe means (71) movable downwardly in timed relation to the downward movement of the upper jaw toward the lower jaw and positioned downstream from the counter-blade for tightening the downstream projecting sheath against the counter-blade prior to the severing of the sheath by the knife and for clamping the severed downstream projecting sheath to a stacking table (67) positioned vertically below the counter-blade, characterized in that the pair of drive and return timing pulleys (130 and 131) are journally mounted in a fixed in place location to the lateral side members (1 and 1) of the machine, and that a horizontal plane passing tangent to the lowermost point of the pair of timing pulleys is vertically located a fixed distance above a horizontal plane passing through the groove (54*a*) of the counter-blade, and that the length of the looped timing belt is greater than the distance between two parallel vertical planes passing tangent to the lateralmost point of the pair of timing pulleys providing a slack in the midsection of the timing belt, and that the lowering means includes a slack take-up and belt displacement means (135, 136, 143 and 137, 138, 144) which is mounted for vertical movement in timed relation to the movement of the upper welding jaw and engages with the opposite internal toothed sides of the timing belt along the midsection taking up the slack, the slack take-up and belt displacement means moving the slack along the upper midsection of the belt to the lower midsection of the belt thereby positioning the blade on the timing belt for entry into the groove of the counter-blade for severing the sheath tightened by the blocking shoe means.

10. In the invention claimed in claim 9, further characterized in that the slack take-up and belt displacement means comprise two pairs of upper and lower guide pulleys horizontally spaced apart and journally mounted to a pair of upright riser members (143 and 144), the guide pulleys vertically spaced on the riser members a distance equal to take up the slack in the midsection of the timing belt, the riser members movable between a high position where the slack is moved to the upper midsection of the belt by the upper guide rollers thereby defining a holding position of the timing belt and the knife and movable to a low position where the slack is moved to the lower midsection of the belt by the lower guide rollers thereby defining the operating position of the cutting apparatus and positioning the knife on the timing belt for entry into the groove of the counter-blade.

11. In the invention claimed in claim 10, further characterized in that the blocking shoe means is fixed to the pair of riser members and that the lower guide wheels are journally mounted through openings in a vertical leg of the blocking shoe means to the riser members.

12. In the invention claimed in claim 11, further characterized in that a channel member (57) is fixed to the vertical leg of the blocking shoe means and extends horizontally between the lower guide pulleys and provides a guide for the lower midsection of the timing belt.

13. In the invention claimed in claim 9, further characterized in that the counter-blade comprises a retaining shoulder (54) on the lower welding jaw and having the transverse groove (**54*a***) located in a vertical face below the shoulder and upstream of the blocking shoe means.

14. In the invention claimed in claim 10, further characterized in that one of the timing pulleys is journally mounted in a bearing box 134, and the bearing box is mounted to the side member for horizontal movement, and means are provide for moving the bearing box and tensioning the timing belt around the timing and guide pulleys.

* * * * *